US007520706B2

(12) United States Patent
Winsor

(10) Patent No.: US 7,520,706 B2
(45) Date of Patent: Apr. 21, 2009

(54) VEHICLE RESTRAINING SYSTEM FOR TRANSPORTING VEHICLES IN A TRANSPORT CARRIER

(76) Inventor: Robert Winsor, 3493 Atwater Ave., Apt. 19, Montreal, Quebec (CA) H3H 1Y2

( * ) Notice: Subject to any disclaimer, the term of this patent is extended or adjusted under 35 U.S.C. 154(b) by 19 days.

(21) Appl. No.: 11/840,027

(22) Filed: Aug. 16, 2007

(65) Prior Publication Data

US 2009/0047088 A1 Feb. 19, 2009

(51) Int. Cl.
*B60P 7/08* (2006.01)

(52) U.S. Cl. ..... 410/7; 410/87; 410/121; 410/127

(58) Field of Classification Search ..... 410/7, 410/18, 87, 88, 117, 121, 122, 123, 127, 410/128; 248/562, 565, 602, 636, 206.2, 248/206.3, 351, 362; 267/140.13, 140.11
See application file for complete search history.

(56) References Cited

U.S. PATENT DOCUMENTS 6,036,417 A * 3/2000 Weaver ..... 410/7

* cited by examiner

*Primary Examiner*—Stephen Gordon
(74) *Attorney, Agent, or Firm*—Ogilvy Renault LLP

(57) ABSTRACT

A vehicle restraining system for restraining vehicles transported in a transport carrier is described. The system comprises at least one energy absorbing mechanism which is secured to the transport carrier. Adjustable connectors are displaceably secured to the energy absorbing mechanism. A connector strut is pivotally connected at one end to a respective one of the adjustable connectors. The connector strut has a vehicle engaging suction cup assembly at a free end thereof for securement at a predetermined location to a vehicle to be transported by the transport carrier, and preferably, but not exclusively, the front and rear windows of vehicles being transported. The connector strut functions to connect the vehicle to the energy absorbing mechanism and transmit forces between the two. The connector strut also has a vacuum pumping piston mechanism that is activated by vehicle displacement during transport to assure a continued vacuum in the suction cups.

21 Claims, 13 Drawing Sheets

VEHICLE RESTRAINING SYSTEM FOR TRANSPORTING VEHICLES IN A TRANSPORT CARRIER

TECHNICAL FIELD

The present invention relates to a vehicle restraining system for use in a vehicle transport carrier and wherein the restraining system is secured to the transport carrier and preferably, but not exclusively, also connectable to the front and rear windows of the transported vehicles.

BACKGROUND ART

For many years, vehicles were restrained in transport carriers, such as a railcar or road transporters, by rigidly connecting the undercarriage of the vehicles to the decking by the use of chains. This resulted in the transmission of severe railcar impact loads to the vehicles and therefore requiring heavy and undesirable vehicle frame reinforcements. Later, chock systems were developed which tied the vehicle wheels vertically down onto the carrier deck of the transport carrier in proximity to the chocks secured fore and aft of each wheel. These systems are still being used today on tri-level railcars used to transport smaller vehicles. However, the evolution of automobile styling is resulting in reduced clearance in the wheel well area and limiting the ease of use of these systems. Concurrently, another system using chocks trapping, but not attaching the vehicle wheels to the railcar deck, was developed. This is still the system of choice for bi-level railcars used to ship larger vehicles such as pick-up trucks, vans, SUV's and jeeps. However, despite its many advantages, this system allows the vehicles to climb up the inclined face of the chock and move vertically during severe railcar impacts. Consequently, a minimum amount of space is required between the vehicles being transported and the railcar overhead structures and this prevents the use of this system in tri-level railcars where the deck clear height is less than on bi-level railcars. These systems are awkward to install adjacent to the vehicle tires and to remove as there is little space between the vehicles being transported and the side walls of the railcars.

SUMMARY OF INVENTION

It is a feature of the present invention to provide a vehicle restraining system which substantially overcomes the above-mentioned disadvantages of the prior art and which comprises at least one energy absorbing mechanism secured to a transport carrier and provided with connector struts adjustably secured thereto to connect to vehicles being transported to restrain them in a space and to provide energy absorption and restrict displacement of the vehicles during transport.

Another feature of the present invention is to provide a vehicle restraining system which is arranged and oriented so as to be easy and quick to connect and disconnect to vehicles transported in a transport carrier.

Another feature of the present invention is to provide a vehicle restraining system which is flexible and which can be adapted to connect to vehicles of different sizes.

Another feature of the present invention is to provide a vehicle restraining system which uses the smooth, hard surfaces of the front and rear windows of the vehicle as the element for connection thereto through the use of vacuum cups as the connecting means.

Another feature of the present invention is to provide vacuum maintenance pumping means built in to the connection struts and utilizing the oscillation of the vehicles being transported to create the pumping energy that continually restores vacuum to the suction cups in the event of leakage.

Another feature of the present invention is to provide a securement system that is entirely integral with the transport vehicle with no loose components to become lost or left on the deck to be subject to damage.

Another feature of the present invention is to provide that all transported vehicles are secured spaced apart and move longitudinally fore and aft in concert controlled by the vehicle restraining system such that the vehicles can be shipped with its transmission in neutral thereby eliminating forces normally imposed on the vehicle transmission systems by the current securement means.

According to the above features, from a broad aspect, the present invention provides a system for securing and restraining vehicles transported in a transport carrier. The system comprises at least one energy absorbing mechanism which is secured to the transport carrier. At least two adjustable connectors are displaceably secured to the energy absorbing mechanism. A connector strut is pivotally connected at one end to each of the adjustable connectors. The connector strut has at least one vehicle engageable suction cup at a free end thereof for securement at a predetermined surface location of a vehicle to be transported by the transport carrier. The connector strut has a vacuum pumping piston mechanism actuated by vehicle oscillation and displacement during transport. The connector strut serves to transmit forces related to these oscillations and displacement into the energy absorbing mechanism and to transmit forces from the energy absorbing mechanism to restore vehicles to their original positions on support decks of the transport carrier.

BRIEF DESCRIPTION OF DRAWINGS

A preferred embodiment of the present invention will now be described with reference to the accompanying drawings in which:

FIG. 6 is a perspective view of a damping device secured at opposed ends of the damping cable;

FIG. 12 is a view similar to FIG. 11 but with the pumping piston in its uncompressed position;

DESCRIPTION OF PREFERRED EMBODIMENTS

Figure 1:
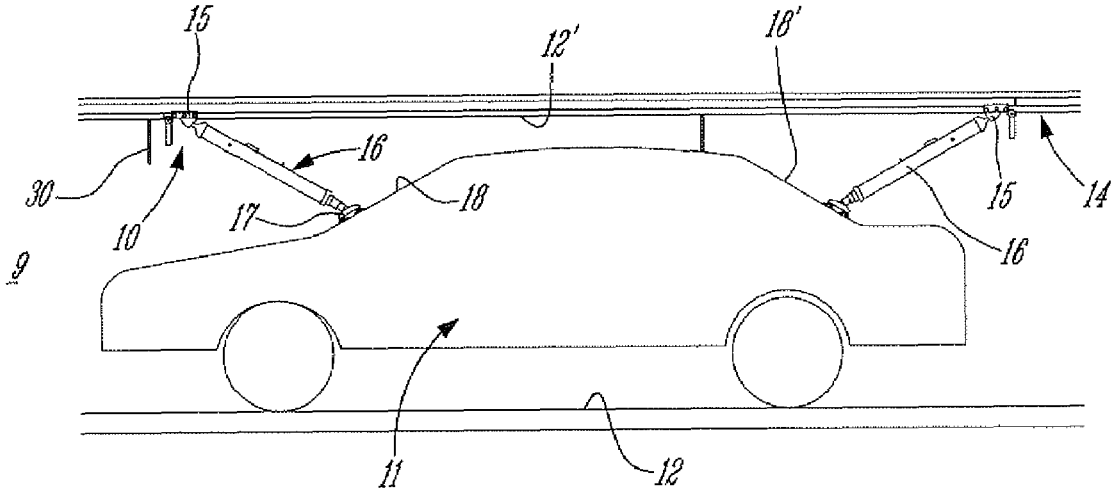
FIG. 1 is a simplified illustration of the vehicle restraining system connected to a structure of a transport carrier and to a vehicle being transported thereby.
Figure 2:
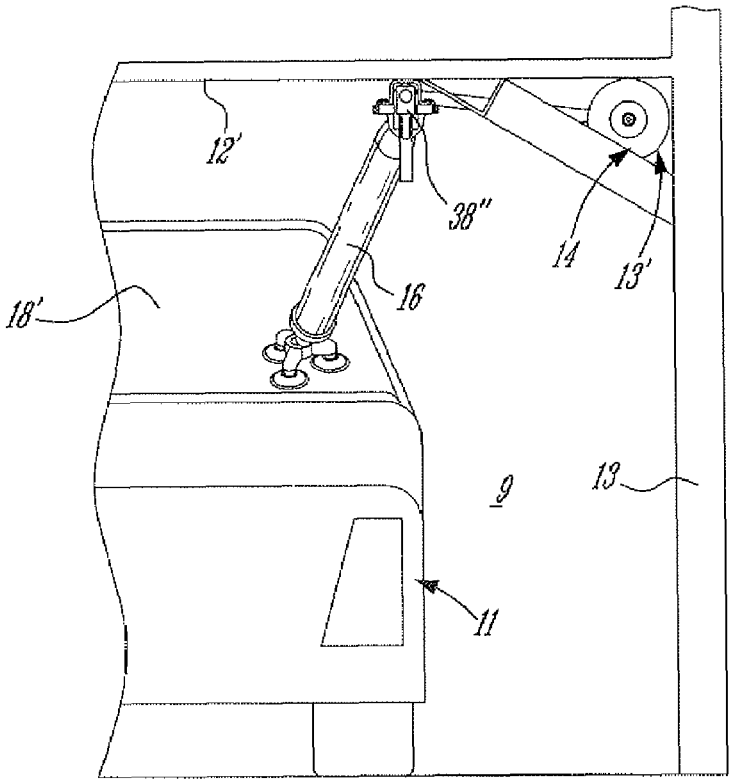
FIG. 2 is a fragmented rear view showing the vehicle restraining system connected to one side of a transport carrier structure, there being an identical system secured to the other side of the transport carrier and connected to a window of a vehicle being transported.

Referring now to the drawings and more particularly to FIGS. 1 and 2, there is shown generally at 10 the vehicle restraining system of the present invention for restraining vehicles 11 transported in a transport carrier such us a railcar carrier or road transport carrier. As hereinshown, only the deck 12, roof 12' and side structure 13, including the angular transition 13' to the roof 12', of such carrier is schematically illustrated. The vehicle restraining system 10 comprises at least two energy absorbing mechanism 14 secured to the transport carrier.

As shown in FIGS. 1 and 2, there are two energy absorbing mechanisms 14 each located on the roof structure 12' and within the side wall structures 13 in a top corner 13' thereof. At least two adjustable connectors 15 are displaceably secured to the energy absorbing mechanism 14 whereby to connect to each of two connector struts 16. The two connector struts 16 are secured to a respective connector 15 at one end and at an opposed end are provided with a vehicle engageable means, herein in the form of at least one suction cup 17, attached to the front and rear windows 18 and 18', respectively, of the vehicle 11 to be transported. The suction cups 17 could also be secured to the body of the vehicle at another convenient location. Other forms of vehicle engageable means are also contemplated and some of which may be obvious to a person skilled in the art.

With reference now to FIGS. 3 to 7D, there will be described the construction of the energy absorbing mechanism 14. As previously mentioned there are two such mechanisms retained on the roof 12 and in opposed top corners 13' of the side wall structures 13 of the vehicle carrier but it is conceivable that a single energy absorbing mechanism 14, or a number of them, could be located elsewhere in the vehicle envelope space 9 shown in FIGS. 1 and 2. Each of the energy absorbing mechanisms 14 has a straight axially displaceable section, herein constituted by a straight section of a steel cable 20, although a metal bar or strong rope could also be used, and to which the adjustable connectors 15 are displaceably secured. As shown in FIG. 6, damping means in the form of a damping cylinder housing 21, containing a preloaded spring assembly 22, is secured to opposed ends of the cable 20. If a straight steel rod was used for the straight connecting portion, then the ends of the steel rods would be spliced to a cable which could be trained about guide pulleys 23 to connect to the preloaded spring assembly 22 provided at opposed ends of the cable 20.

Figure 3:
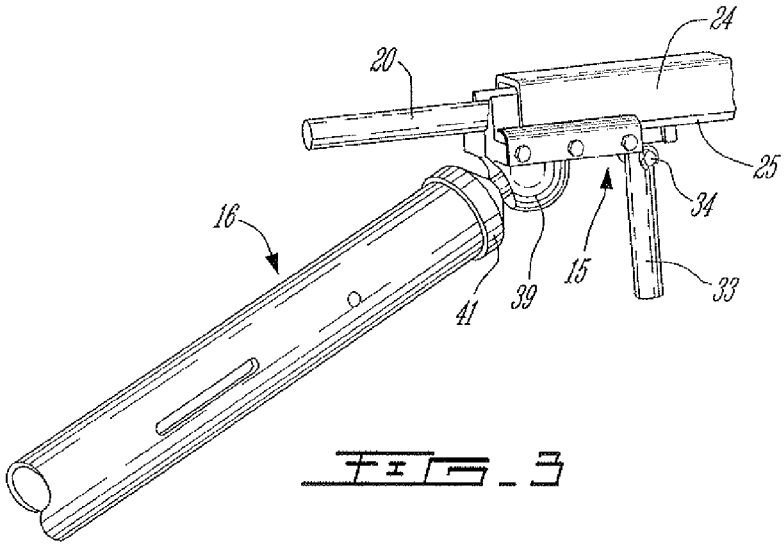
FIG. 3 is a perspective view showing the manner in which a connector strut is pivotally connected to the energy absorbing mechanism.
Figure 4A:
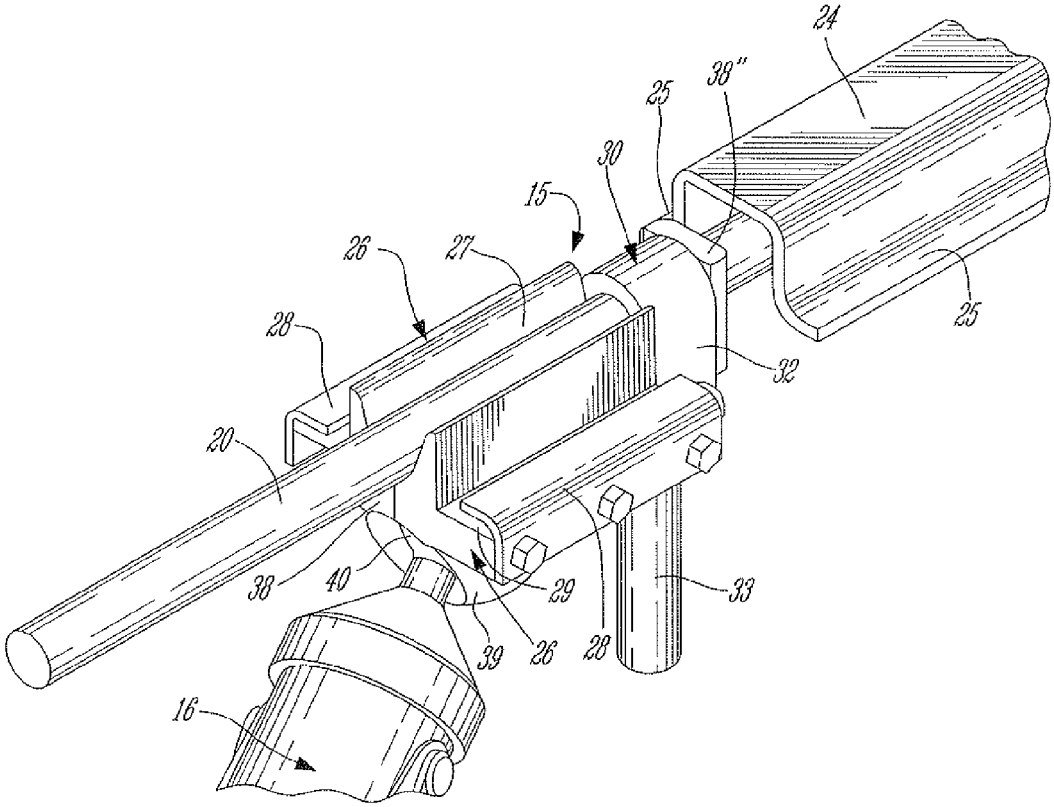
FIG. 4A is an enlarged view illustrating the construction of the sliding connector secured to an energy absorbing steel cable of the mechanism.
Figure 4F:
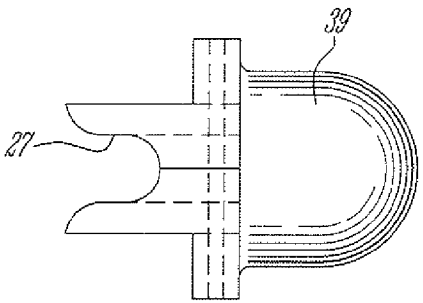
FIGS. 4B, 4C, 4D and 4F are a side view, a top view, a first end view and an opposed end view of the cradle.
Figure 4E:
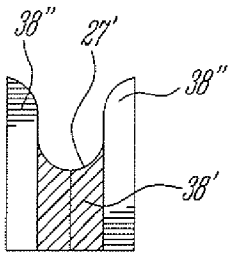
FIG. 4E is a cross-section view along cross-section line 4F-4F of FIG. 4B.
Figure 4C:
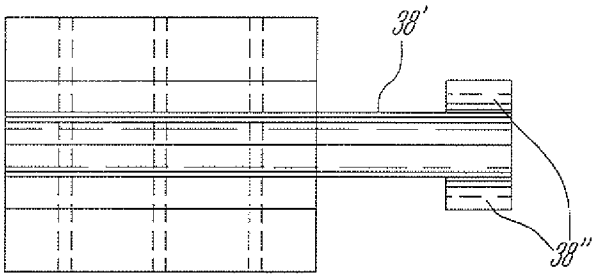
Figure 4B:
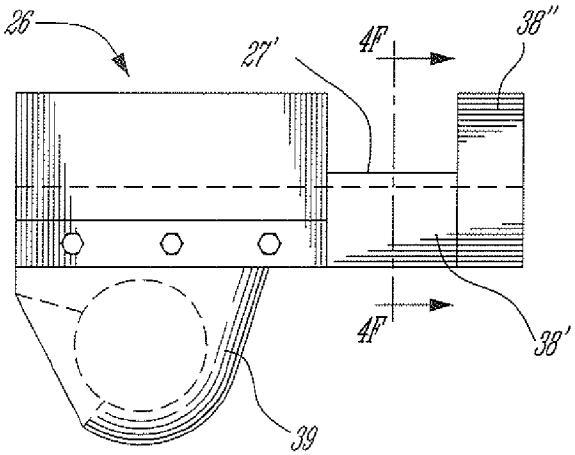
Figure 4D:
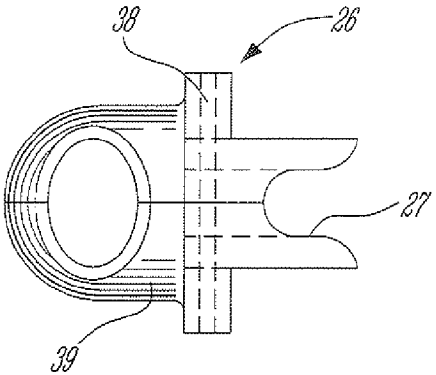
Figure 5A:
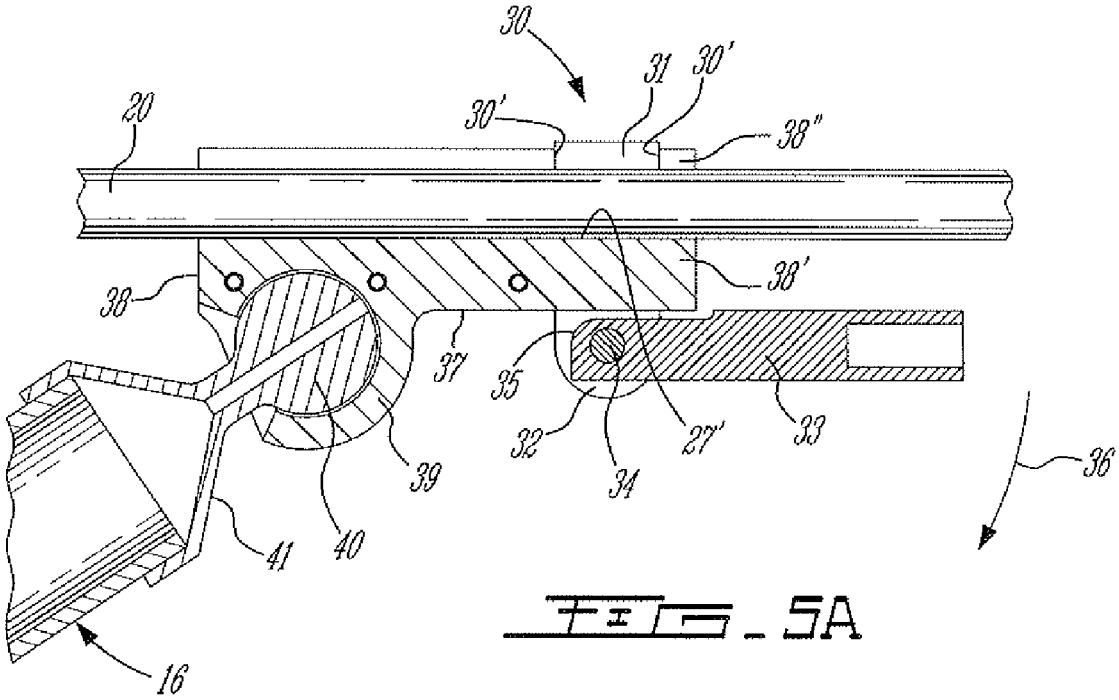
FIGS. 5A and 5B are enlarged fragmented side views showing the manner in which the sliding connector is secured to the cable.
Figure 5B:
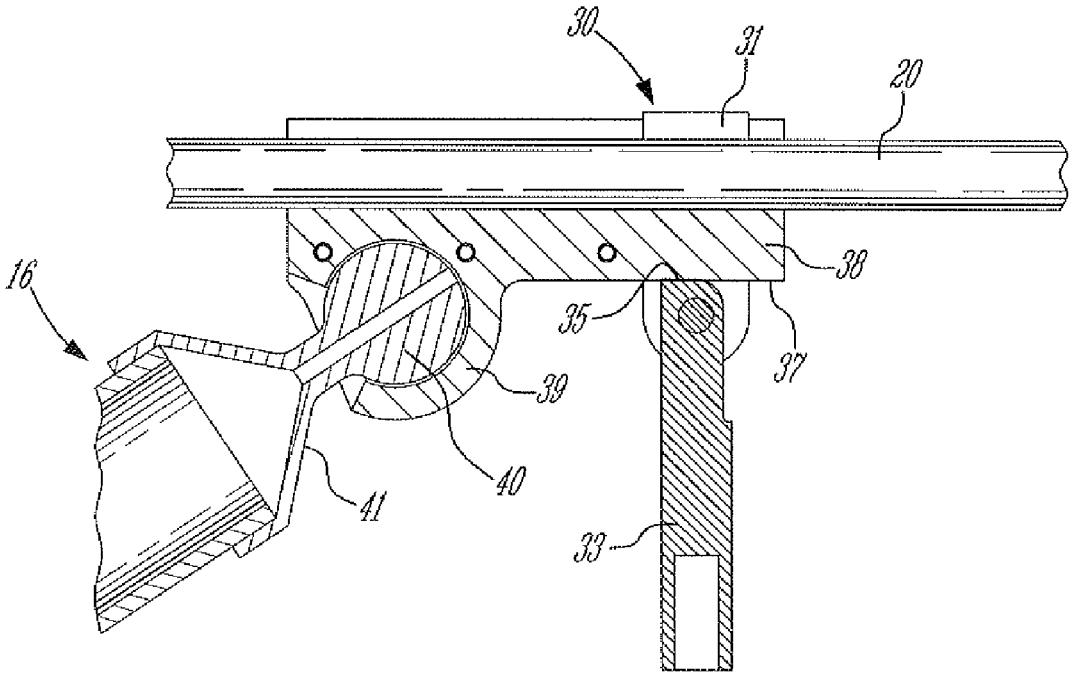
Figure 5:
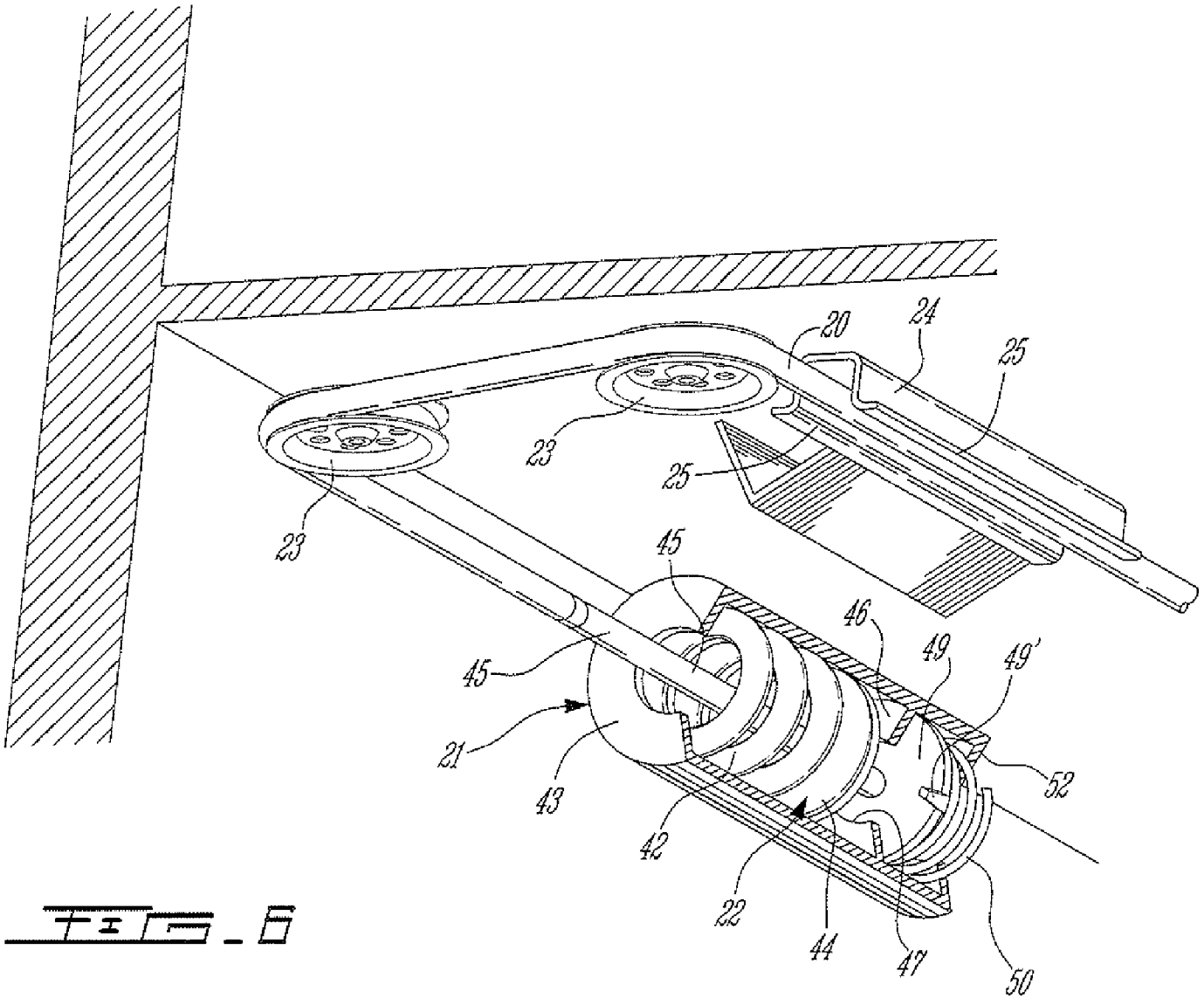

As shown in FIGS. 3 and 4A and elsewhere, the steel cable 20 extends within a fixed inverted U-shape rail 24 which is provided with opposed flanges 25 extending outwardly on opposed sides. The rail 24 is immovably secured to the transport carrier. The connector 15 has a cradle 26 defining a channel 27 through which the cable extends. A retaining flange 28 is secured to opposed sides of the cradle whereby to provide for a slot 29 through which the flange 25 of the rail 24 extends to provide for sliding movement of the adjustable connector 15 along the rail.

In order to arrest and immovably secure the adjustable connector 15 at a desired location along the rail 24, there is provided a U-shaped clamp 30 which interconnects the connector 15 to the cable 20. This clamp construction is illustrated by FIGS. 4B to 4F and includes an inverted U-shaped clamping member 31 through which the cable 20 passes. The clamp 30 has depending arms 32 for pivotal securement thereto of a hand-operable clamping bar 33, as shown in FIGS. 3, 4, 5A and 5B. The clamping bar 33 is connected to the depending arms 32 by a pivot pin 34. The clamp engaging end of the clamping bar has an eccentrically shaped clamping head 35 whereby when the clamping bar 33 is displaced downwardly in the direction of arrow 36, it causes the eccentrically shaped clamping head 35 to engage a lower surface 37 of the cradle 26 to pull down on the clamping member 31 to exert a clamping force against the cable 20 pinching it against the bottom of the channel 27, thus immovably securing the clamp 30 and thus the adjustable connector 15 to the cable.

With reference to FIGS. 2, 4A to 4F, 5A and 5B, it can be seen that the bottom wall 38 of the cradle has a narrow extension portion 38' to which are attached two ribs 38" on either side creating a cavity in which clamp 30 is retained.

When the eccentrically shaped clamping head 35 exerts a downward pulling force on the U-shaped clamp 30, the portion of the cable under the clamp is urged against the top surface 27' of the extension portion 38' and immovably retained thereon to secure the connector strut 16 at the desired location along the cable 20.

As shown in FIGS. 4A to 4F, the bottom wall 38 of the cradle 26 has a connecting socket 39 secured thereto whereby to receive the connecting ball 40 secured to the connecting end 41 of the connector strut 16. The cradle 26 can be formed by two identical mirror-image parts as shown, each also containing a half section of the connecting socket 39 and the cradle is assembled about the connecting ball 40 to retain it captive thereto. The clamping bar 33, when at its engaged position, extends in a downward clamp position. In order to disconnect the slideably adjustable connector from the cable 20 and slide it along the rail 24 it is simply necessary to lift the bar 33 to disconnect the clamp from the cable and to move the connector a long the rail. Further, the connector struts are always connected to the rail via the connectors 15 and there are therefore no loose parts which could be lost or misplaced.

Figure 7A:
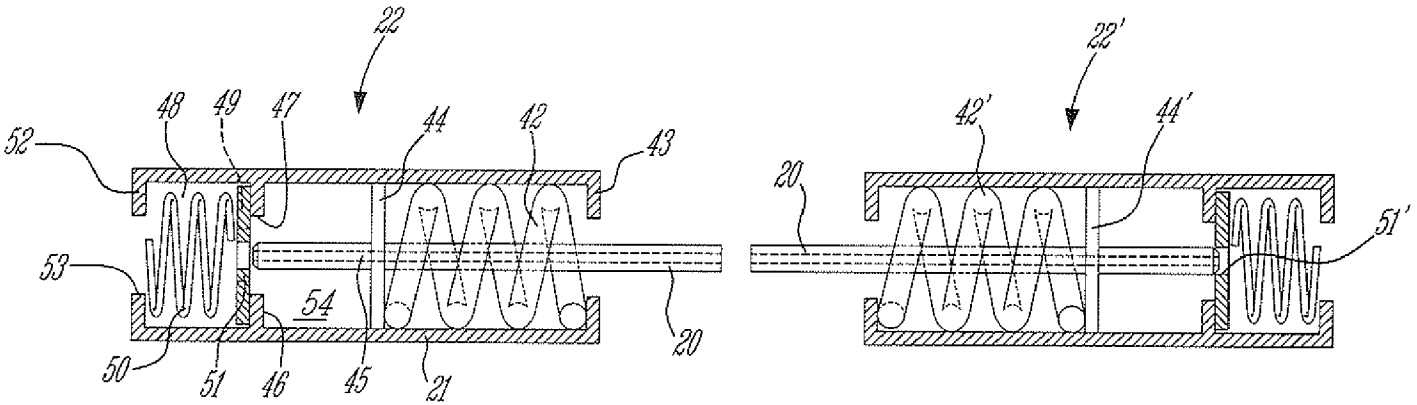
FIGS. 7A to 7D are section views of the damping devices secured at opposed ends of the energy absorbing cable and illustrating the operation of the damping devices.
Figure 7B:
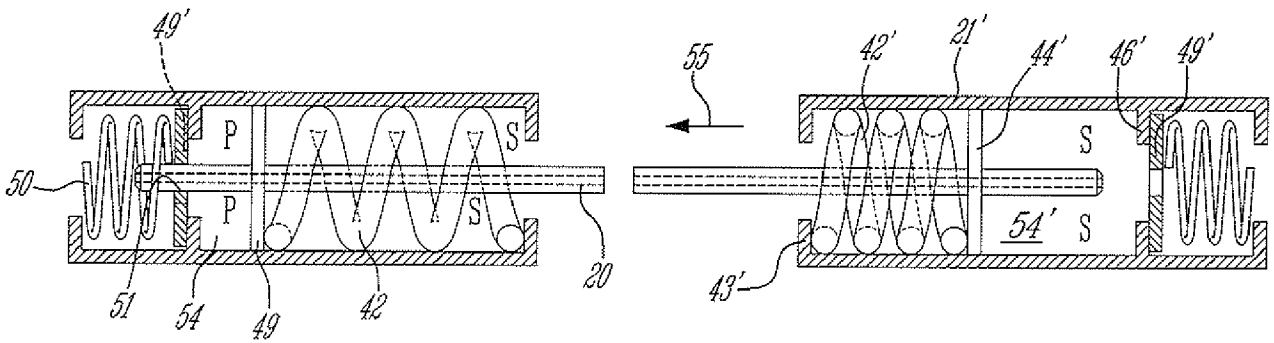
Figure 7C:
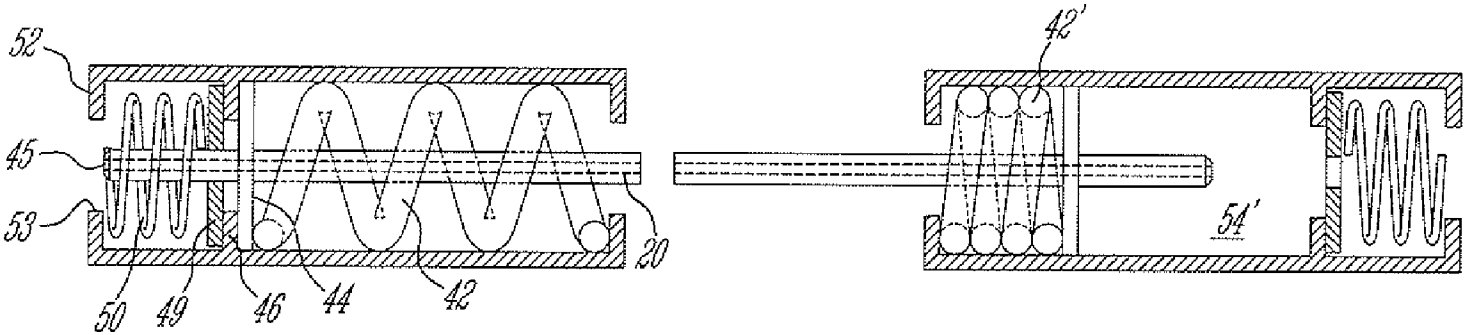
Figure 7D:
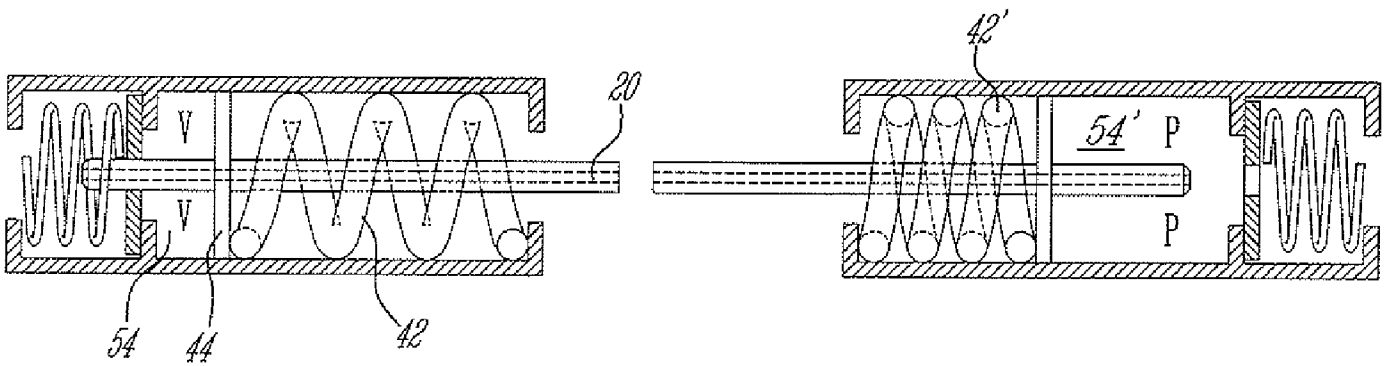

With reference now to FIGS. 6 to 7D, there will be described the construction and operation of the damping means connected at opposed ends of the cable 20. As hereinshown this damping means is constituted by a preloaded spring assembly 22 consisting of a preloaded helical spring 42 retained captive in a damping cylinder housing 21 between a cable entrance end wall 43 and a disc 44 secured about a straight rod end portion 45 of the cable 20. The disc 44 is spaced from an internal wall 46 which has a central opening 47 through which the straight rod end portion 45 can pass.

A disc washer 49 constitutes an obstruction means of the exit opening 47 and it is located on a side of the internal wall 46 opposite to that side facing the disc 44. This disc washer 49, in a normal non-damping position of the pre-loaded spring assembly 22, is biased against the internal wall 46 by a helical spring 50 located in a spring housing chamber 48 defined between the internal surface of the damping cylinder 21, the face of the disc washer 49 and the damping cylinder end wall 52. The disc washer 49 has a small central hole 51 for the passage of the rod end portion 45 and also has notches 49' (see FIG. 6) in its peripheral circumference to permit the passage of air when it is not positioned tightly against internal wall 46. The damping cylinder end wail 52 is also provided with an opening 53 therein to permit the free passage of air. The chamber 54 between the disc 44 and the internal wall 46 defines a vacuum damping chamber as will be described.

As shown in FIG. 7A, spring 42 at one end of the cable 20 and opposed spring 42' at the opposed end of the cable 20 are equally preloaded (compressed) thereby tensioning the cable 20 stretched between them, with the system at rest.

In FIG. 7B the cable 20 is displaced in a leftward axial direction as indicated by arrow 55 causing the cable to further compress spring 42' while simultaneously permitting spring 42 to relax, hence the combined forces of the two springs urge the cable to return in the direction opposite to arrow 55. This force increases progressively the further the cable 20 is displaced in the direction of the arrow 55 and this progressively increases the damping force impeding the motion of the system contained by the cable 20 between the preloaded spring assemblies 22 and 22'. Disk 44 which is secured to the straight rod end portion 45 of the cable 20 is moving in concert with cable 20 in the direction of the arrow 55 and causing a pressure "P" to build up in the chamber 54 in cylinder 21 between the disc 44 and inside wall 46 which is blocked by the disc-washer 49 in turn urging the disc washer 49 to move in the direction of the arrow 55, compressing spring 50 and permitting air to escape through exit opening 47 in the internal wall 46 and through the notches 49' in the periphery of the disc washer 49. Suction "S" in chamber 54' of cylinder 21' is caused as disc 44' moves away from internal wall 46' but this suction is relieved as air can readily flow through hole 51' in disc-washer 49' preventing the build up of a restraining vacuum in chamber 54'. Thus the continued motion of the cable 20 in the direction of arrow 55 is restrained only by the increasing compression of the spring 42' in spring assembly 22' and not by any pressure build up in spring assembly 22, thereby insuring that the cable 22 is always in tension and never in compression.

Referring now to FIG. 7C, the motion of the cable 20 in direction 55 has ceased, and the spring 42' is completely compressed, although that need not be the case for the system to cease moving in the direction of arrow 55. The spring 50 has urged the disk washer 49 against the internal wall 46 restricting the flow of air through the notches 49' and rod end portion 45 is substantially filling the hole 51 in disc-washer 49 thereby restricting air flow through hole 51. Thus air cannot flow through hole 47 in wall 46 except as permitted by slight leakage.

Referring now to FIG. 7D, a vacuum build up "V" will begin to occur between inside wall 46 and disk 49 as spring 42' pulls the cable 22 in the reverse direction to arrow 55, this vacuum restraining the disk 44 from moving in the direction opposite to arrow 55 and preventing the entire system connected to cable 22 from returning violently in the direction opposite to arrow 55 but instead returning in a controlled fashion without oscillation.

Referring now to FIGS. 8 to 12, there will be described the construction and function of the damping connector strut 16. As shown, the damping connector strut 16 is in the form of an elongated cylinder having a cylindrical housing 60. A vacuum pumping piston mechanism 61 is secured in a lower end portion 62 of the cylindrical housing 60 and through which a piston rod 63 projects. As hereinshown, there are three suction cups 17 secured to the connecting end of the piston rod, but there could be as few as one, as previously mentioned. In this arrangement these suction cups 17 are equidistantly spaced-apart about a connecting yoke 64 which clamps about a ball end connector 65 formed at the free end of the piston rod 63. The piston rod 63 is provided with a vacuum conduit 66 which connects to the suction cups 17 by distribution conduits 66'. The yoke connection provides for this suction cup assembly to pivot at the free end of the piston rod 63.

Figure 9:
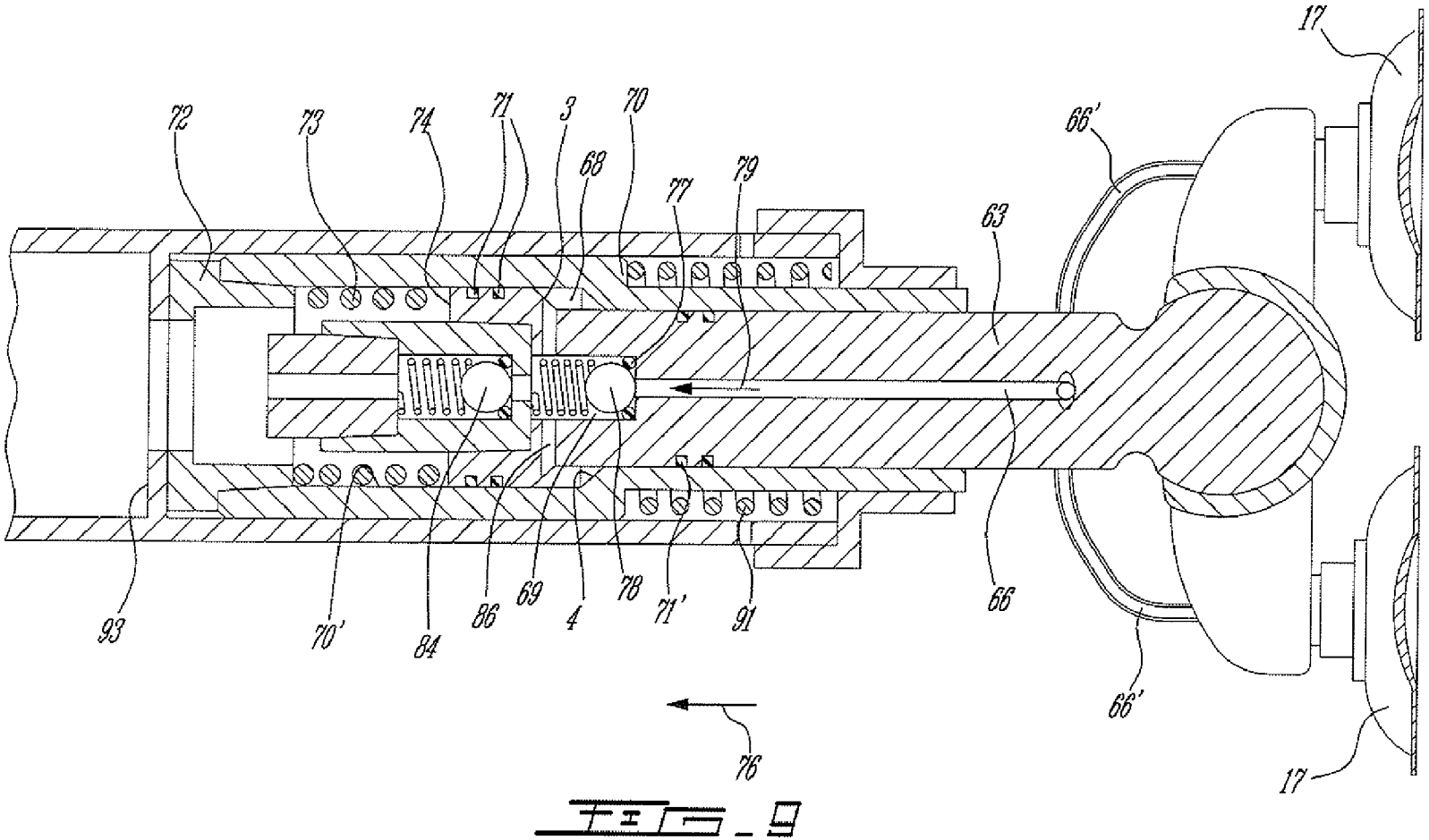
FIG. 9 is an enlarged section view illustrating the construction of the vacuum pumping piston mechanism of the damping connector strut.

As shown in FIG. 9, the vacuum conduit 66 connects through lateral connection conduits 86 to a suction chamber 67 which is formed by the upwards displacement of a piston head portion 68 formed at the upper end of the piston rod 63 within a displaceable piston housing 70 in the direction of the arrow 76. The conduit 66 connects to this suction chamber 67 through a check valve chamber 69. The displaceable piston housing 70 is retained in sliding displacement in the cylindrical housing 60 and the piston rod 63 extends therein.

The upper end of the displaceable piston housing 70 defines a piston head cylinder portion 70' in which the piston head portion is displaced.

Figure 10:
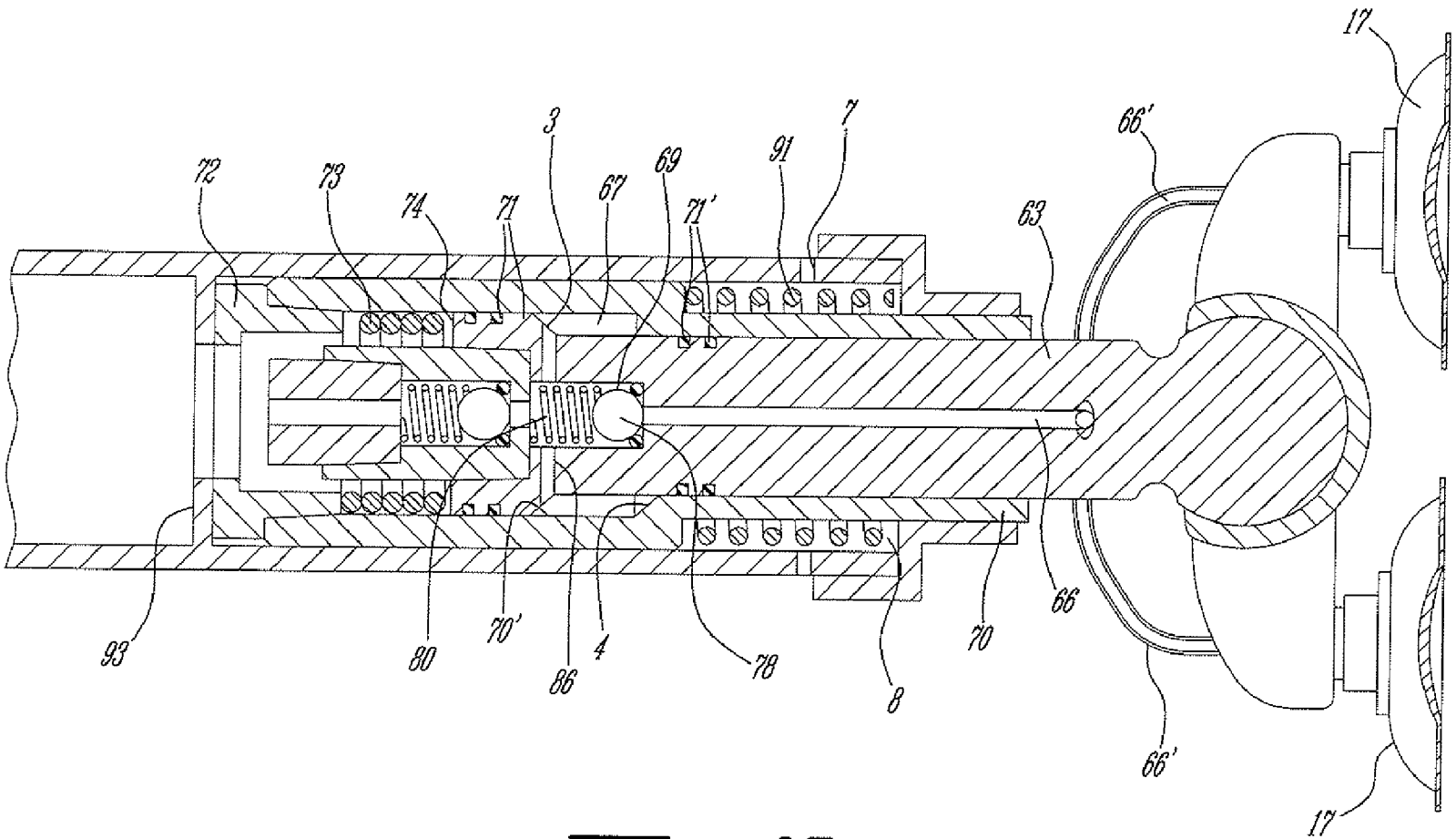
FIG. 10 is an enlarged fragmented section view of part of the connector strut at a compressed position.

The suction chamber 67 is defined between the inner surface of the cylinder portion 71' and the outer surface of the piston rod 63 as well as the sloping surface 3 of the lower end of the piston head portion 68 and the mating sloping transition surface 4 of the displaceable piston housing 70, which two surfaces separate when the piston rod 63 moves in the direction of arrow 76, as shown by FIG. 9 and is at a maximum when piston rod 63 is at the maximum travel as shown in FIG. 10. The vacuum created by the expanding vacuum chamber 67 in turn will apply suction through the lateral connection conduits 86, the check valve chamber 69, conduit 66, the distribution conduits 66' and consequently into the suction cups 17. The compression stroke is limited by compression spring 73 compressing to a solid condition against the end plug 72 which is itself affixed to displaceable piston housing 70 and is in contact with the interior wall 93 as shown in FIG. 10.

The piston 63 is displaceable in the piston housing 70 and is provided with O-rings 71 around the head portion 68 and 71' around the main body 63 to maintain a seal with the inside surfaces of the displaceable piston housing 70 so that there is minimal leakage into the vacuum chamber 67 during the pumping stroke.

The helical compression spring 73 is held captive in a compressed state in the piston head cylindrical portion 70' between an end plug 72 and the upper end surface 74 of the piston head 68 (see FIGS. 9 and 10). Accordingly, piston rod 63 is constantly urged by spring 73 into its fully extended position relative to the displaceable piston housing 70 and when the piston rod 63 is displaced upwardly, this spring 73 is further compressed to apply a substantial restoring force on the piston rod 63 urging it to its normal position fully extended within displaceable piston housing 70.

The vacuum created by compressing the piston rod 63 is transmitted through lateral connection conduits 86 into check valve 69 which will draw the bail valve 78 to be displaced from its seat 77 in the direction of arrow 79 thereby connecting the vacuum conduit 66 to the suction chamber 67. This is the pumping stroke, as previously described, that maintains the suction within the conduit 66, the connecting channels 66' and the suction cups 17.

As shown in FIG. 10 the pumping stroke of the piston rod 63 within the displaceable piston housing 70 has traveled as far as is permitted by the compression spring 73 being fully compressed, thereby ceasing to increase the level of the vacuum in the suction chamber 67. Normally the length of the piston stroke will be less than that shown in FIG. 10, but nevertheless the level of the vacuum in the system will cease to increase when the pumping stroke ceases in accordance with the cessation of the vehicle motion that was the cause of the pumping stroke. It should be noted that the vacuum itself serves to apply a restraining force on the sloping surface 3 of the piston head 68 thereby restraining the travel of piston rod 63 and the vehicle to which the system is attached. When the pumping stroke ceases at any amplitude, the vacuum that had been created by that pumping stroke will now be equal throughout the system from the vacuum chamber 67 down to the suction cups 17, allowing the ball return spring 80 to re-seal the hall 78, thereby sealing the vacuum from the ball seat 77 down the vacuum conduit 66 and the connecting tubes 66' and the vacuum cups 17.

Figure 11:
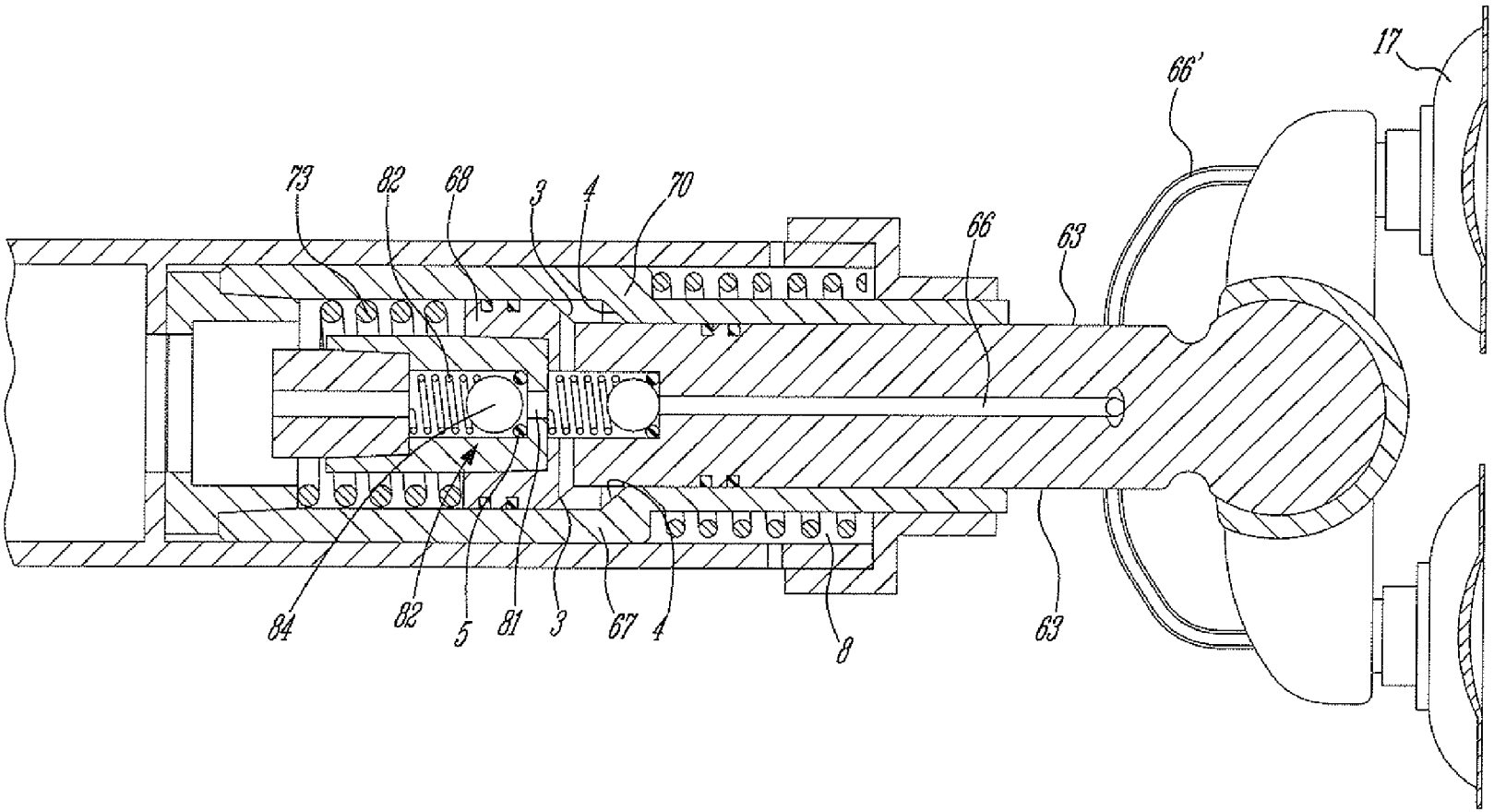
FIG. 11 is an enlarged fragmented section view of part of the connector strut in a partially compressed position with the pumping piston returning to its normal uncompressed position.
Figure 11:
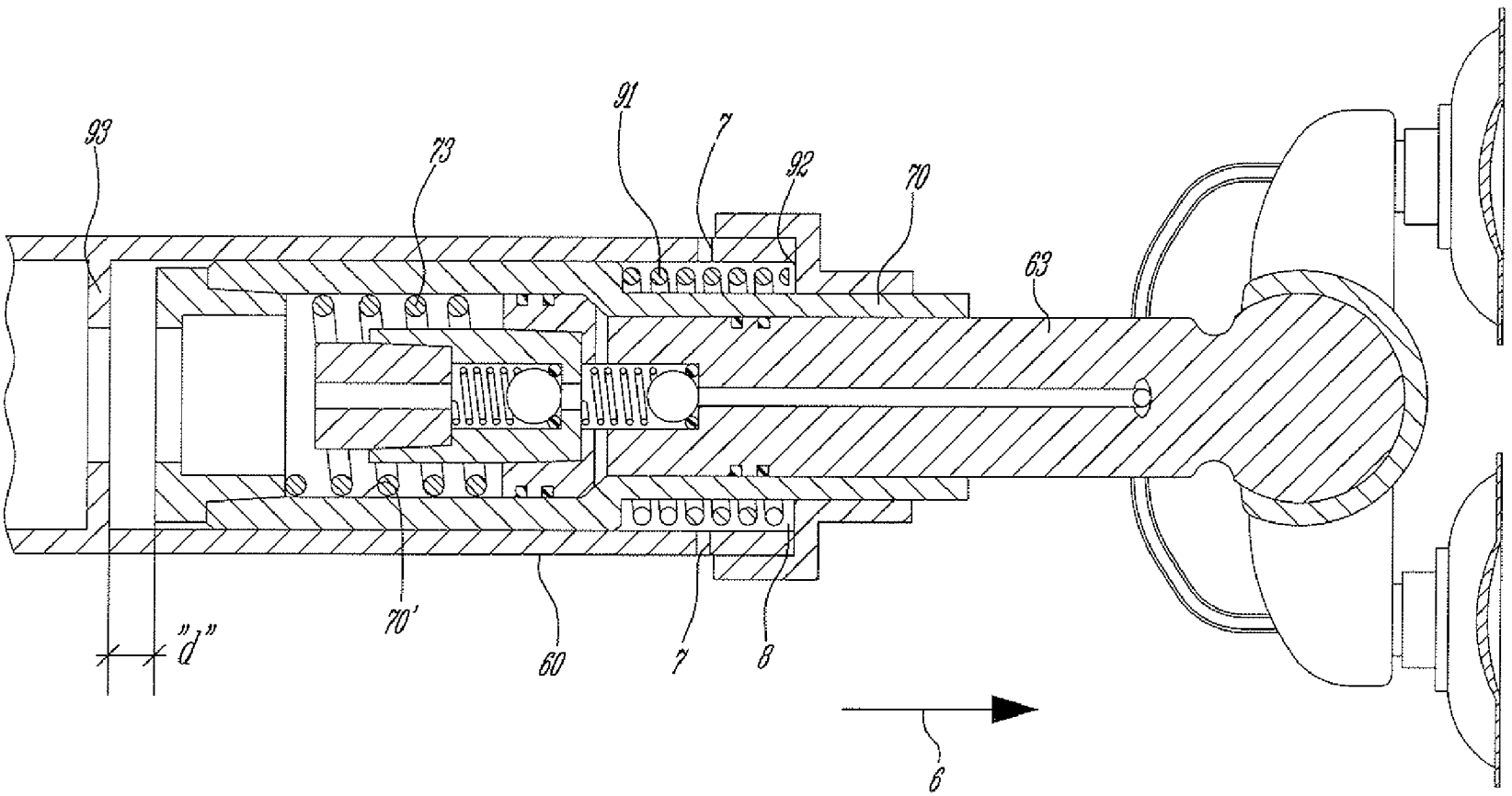

Referring now to FIG. 11, the piston rod 63 is being urged by spring 73 in the direction of arrow 1 to return to its normal extended position. This causes the vacuum chamber 67 to decrease in volume as the sloping surface 3 of the piston head portion 68 moves towards contact with the sloping transition surface 4 of the inner wall of the displaceable piston housing 70, in turn causing a pressure build-up in the vacuum chamber, eventually reaching and exceeding atmospheric pressure. When atmospheric pressure is exceeded this will apply a force through channel 81 and cause ball 84 in check valve 82 to lift and unseat from its seat 5, thereby releasing the pressurized air to escape to atmosphere and permitting the return spring 73 to extend and force the piston 63 to its normal at-rest position fully extended within the displaceable piston housing 70. The vacuum pumping mechanism is now positioned for the next pumping stroke.

As shown more clearly in FIGS. 9 to 12, a helical spring 91 is retained captive in the cavity 8 about the outer wall of the smaller diameter lower end of the displaceable piston housing 70, the inner wall of the lower end of the cylindrical housing 60 and between a lower abutment wall 92 of the strut cylindrical housing 60 and an upper abutment wall formed at the transition between the smaller and larger diameters of the displaceable piston housing 70. This spring 91 normally maintains the retractable piston housing 70 in its fully retracted position in the strut cylinder housing 60 against the abutment wall 93, as shown in FIGS. 9 to 11 where the spring 91 is at its normal at-rest position. As will be described below it is advantageous to permit the connector strut 16 to lengthen a small amount and this is achieved through the compression of the spring 91 allowing the displaceable piston housing 70 to move downwards as shown in FIG. 12 and project further out from its normal position in the strut cylinder housing 60.

Figure 8:
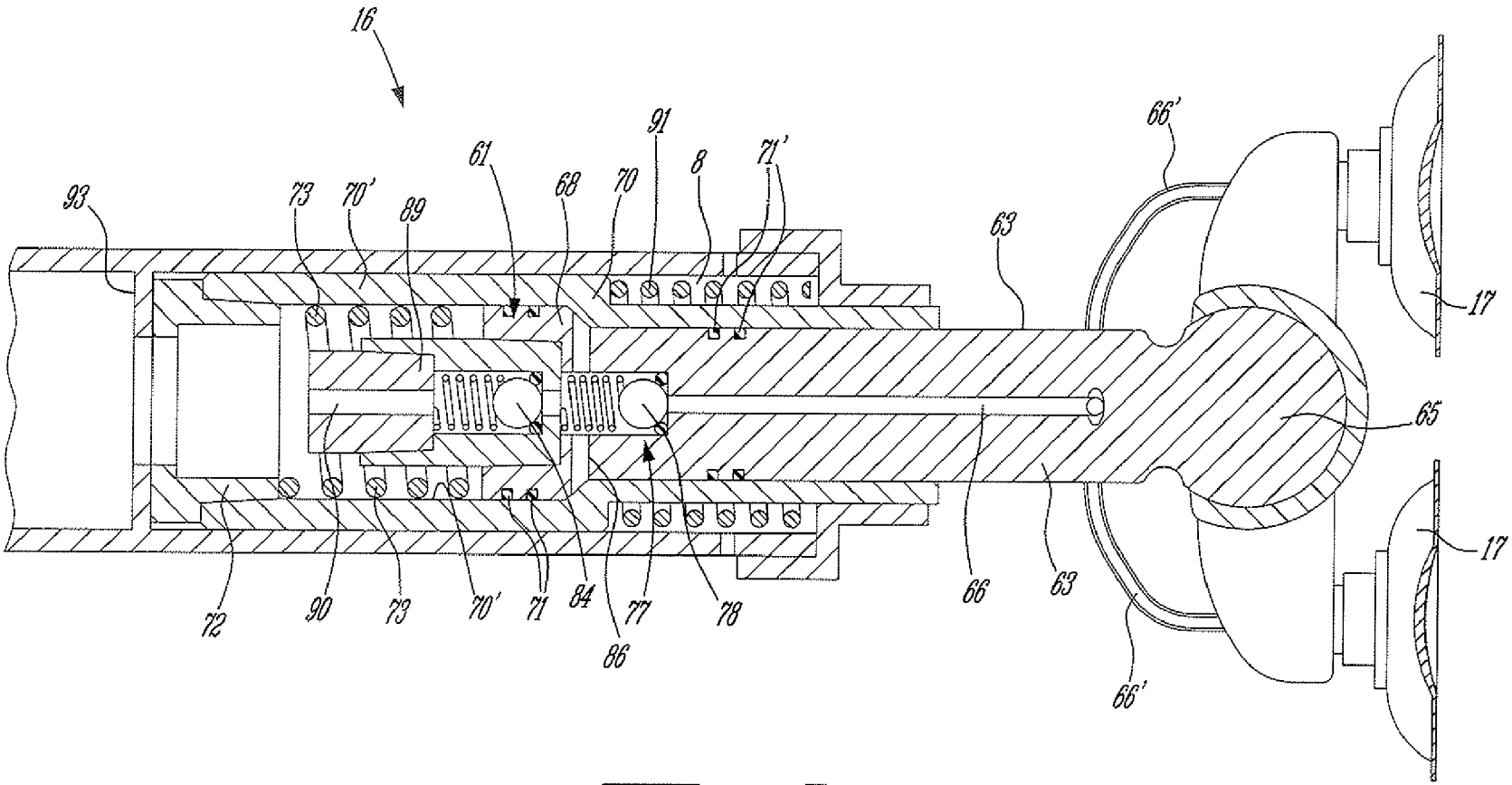
FIG. 8 is a section view through the connector strut with the strut in a normal position.

Referring again to FIG. 1 for general layout, and to FIGS. 8 and 12 for detail, the connection struts 16 are both in their normal at-rest conditions with the piston rods 63 in their fully extended positions within the displaceable piston housings 70 (as urged by compression springs 73) and the displaceable piston housings 70 in their fully retracted positions within the connection struts 16 (as urged by helical springs 91) with the suction cups 17 of opposing connecting struts 16 engaged with the front and rear windows 18 and 18' of the vehicle 11 being transported and restrained. The connection struts 16 are held in that normal condition by the springs, while being applied to the vehicle 11 and being locked into position on the energy absorbing mechanism 14. When the transport carrier 9 subsequently moves and lurches causing the vehicles 11 to move relative to it, the connecting struts on one window will be compressed and retract into its vacuum pumping stroke and the other, opposed connecting struts must extend by the same amount in order that the suction cups 17 remain engaged on both windows. This extension is permitted through the compression of spring 91 allowing the displaceable piston housing 70 to move into an extended position matching the retraction of the connection struts attached to the opposite vehicle window. These compression and matching extension strokes are short, of an order less than 1 inch and do not materially affect the dynamics of the energy absorbing mechanisms 14. Holes 7 in the wall 60 of the strut 16 permit the free flow of air into and out of the helical spring chamber 8 surrounding spring 91 to insure there is no pressure or vacuum build-up in the chamber to inhibit the free extension and subsequent retraction of the displaceable piston housing 70.

As pointed out when the transport vehicle is in operation and being subjected to vibrations and shocks which are transmitted to the vehicles, the piston rods of the struts will move in and out and this action of the piston rod, when compressed, creates a vacuum pump action which maintains and assures a continuous maximization of the vacuum on the suction cups. Further, it is to be pointed out that because more than one vehicle is connected to the energy absorbing cable 20 that it is the totality of the vehicle load that is applied to the cable, that is to say the load of all vehicles attached to the cable and these vehicles will move back and forth in unison with respect to one another as the transport vehicle is subjected to vibration and impacts with the struts maintaining the vehicles regularly spaced from one another. It is also pointed out that the loading on the piston rods of the strut is transferred to the energy absorbing mechanisms which permit a controlled vehicle motion and the absorption of the related kinetic energy to cushion the displacement of the vehicles being transported.

Figure 13A:
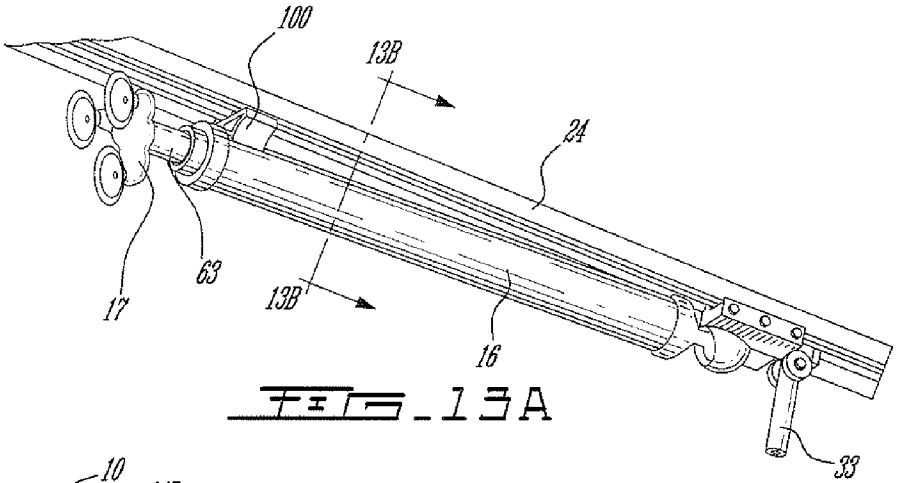
FIG. 13A is a perspective view of the connector strut at a stored position held by a storage magnet.
Figure 14A:
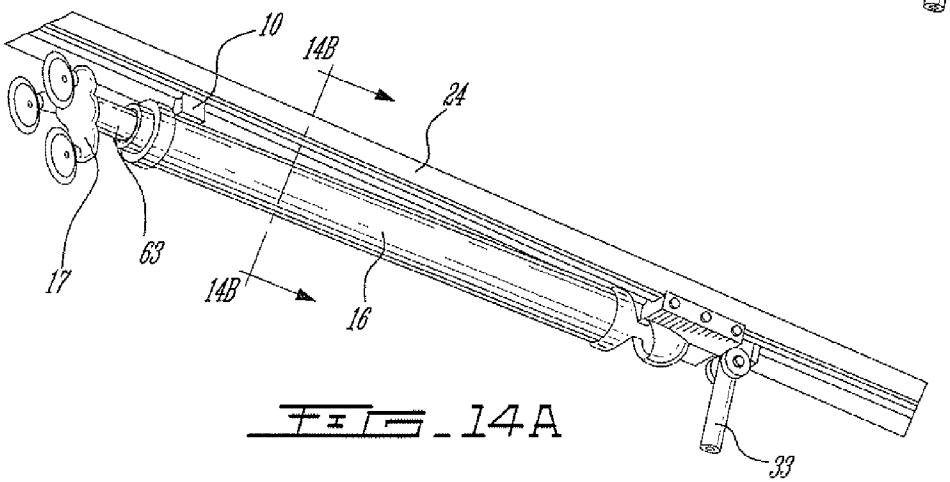
FIG. 14A is a perspective view of the connector strut held at a stored position by a spring clip.
Figure 13B:
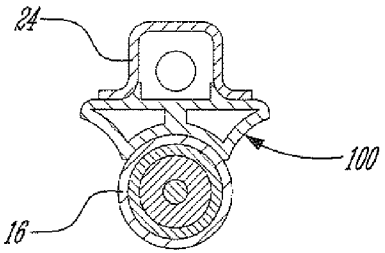
FIG. 13B is a transverse cross-section view of the connector strut of FIG. 13A held by the magnet.
Figure 14B:
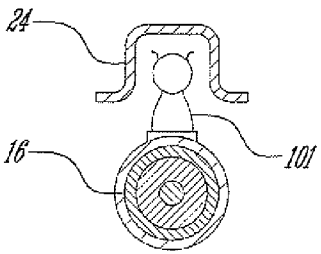
FIG. 14B is a transverse cross-section view of FIG. 14A.

It is necessary to have the connection struts 16 conveniently stored out of the way of vehicles when these are being loaded and unloaded and it is most preferable that the struts be so stored in or close to their position of last use as such positions are likely to be very close to the positions required for the next use. FIGS. 13A and 13B illustrate a first example of a storage mechanism and herein constituted by a storage magnet 100 affixed to the lower end of the connection strut for the purpose of retaining the strut at a stored position parallel to U-shaped rail 24 by magnetic attraction to the rail. An alternate mechanism is shown in FIGS. 14A and 14B wherein a spring clip 101 is affixed to the lower end of connection strut 16 for the purpose of engaging steel cable 20 to hold the strut in the stored position. In both cases clamping bar 33 is in its lower position ensuring engagement with the cable 20 and preventing longitudinal movement of the connecting strut 16 while in the stored position described.

It is within the ambit of the present invention to cover any obvious modifications of the preferred embodiment described herein, provided such modifications fall within the scope of the appended claims.

The invention claimed is:

1. A vehicle restraining system for restraining vehicles transported in a transport carrier, said system comprising at least one energy absorbing mechanism secured to said transport carrier, at least two adjustable connectors displaceably secured to said energy absorbing mechanism, a connector strut pivotally connected at one end to each of said adjustable connectors, said connector strut having at least one vehicle engagement suction cup at a free end thereof for securement at a predetermined surface location of a vehicle to be transported by said transport carrier, said connector strut having a vacuum pumping piston mechanism actuated by vehicle oscillation and displacement during transport, and said connector strut serving to transmit forces related to said oscillation and displacement into said energy absorbing mechanism and to transmit forces from said energy absorbing mechanism to restore vehicles to their original positions on support decks of the transport carrier.

2. A vehicle restraining system as claimed in claim 1 wherein said predetermined surface location is a front and rear windows of said vehicle to be transported.

3. A vehicle restraining system as claimed in claim 1 wherein said vacuum pumping piston mechanism has a piston rod projecting at a connecting free end from a cylinder housing of said connector strut, said at least one suction cup being pivotally connected to said connecting free end, conduit means in said piston rod to connect a vacuum to said at least one suction cup, said conduit means connecting to a suction chamber through a check valve chamber, a displaceable piston housing retained in sliding displacement in said cylinder housing, said suction chamber being defined between said piston rod and said displaceable piston housing during a compressing stroke of said piston rod to apply a suction force in said conduit means and said at least one suction cup, a first check valve maintaining suction in said conduit means during a return stroke of said piston rod and thereafter, a second check valve operable to permit evacuation of air being compressed in the vacuum chamber during the said return stroke of the piston rod.

4. A vehicle restraining system as claimed in claim 3 wherein said piston rod has a piston head section at an upper end thereof displaceable in a piston head cylinder portion of said displaceable piston housing, said piston head cylinder portion having an end closure plug with an air evacuation port therein, and piston return means constituted by a helical compression spring held captive between said piston head and said end closure plug.

5. A vehicle restraining system as claimed in claim 4 wherein a maximum pumping stroke of said piston rod during said compressing stroke is limited by a compression spring compressing to a solid condition against an end closure plug with said displaceable piston housing retracted in said cylinder housing a predetermined distance to be arrested by an abutment wall.

6. A vehicle restraining system as claimed in claim 4 wherein said suction chamber is defined between a forward surface of said piston head and an adjacent forward circumferential shoulder wall of said piston head cylinder portion of said displaceable piston housing.

7. A vehicle restraining system as claimed in claim 5 wherein one or more O-ring seals are provided about said piston head and piston rod to maintain a seal with an inner surface of said displaceable piston housing to prevent air leakage into said suction chamber.

8. A vehicle restraining system as claimed in claim 5 wherein during said compressing stroke vacuum build-up in a vacuum chamber is transmitted into said first check valve through lateral conduits to draw a ball valve of said first check valve to connect said vacuum in said vacuum chamber to said conduit means and said at least one suction cup.

9. A vehicle restraining system as claimed in claim 5 wherein a pumping stroke displacement is caused by motion of a vehicle to which said at least one suction cup at said free end of said connector strut is secured to.

10. A vehicle restraining system as claimed in claim 8 wherein at an end of a pumping stroke said vacuum build-up in said vacuum chamber becomes equal with that in said conduit means connected thereto through said first check valve thereby allowing said ball valve to return to a normal seated position under the influence of a biasing return spring thereby sealing the vacuum in said conduit means and said at least one suction cup.

11. A vehicle restraining system as claimed in claim 8 wherein after said compressing stroke of said piston rod said compression spring urges said piston rod to a normal extended position thereby decreasing the volume of said vacuum chamber and causing increased air pressure therein, said increased air pressure when reaching atmospheric pressure causing a ball valve in said second check valve to open to release said air pressure to atmosphere and permitting said compression spring to return said piston rod to a normal at-rest position within said cylinder housing.

12. A vehicle restraining system as claimed in claim 1 wherein there are three of said suction cups connected spaced-apart to a connecting yoke, and a connecting vacuum tube between conduit means in piston rod and each of said suction cups, said yoke providing pivotal movement between said piston rod and said suction cups.

13. A vehicle restraining system as claimed in claim 1 wherein there are two of said energy absorbing mechanisms, each said mechanism being secured on a respective one of opposed upper sides of a transport carrier envelope space defined above said support decks of said transport carrier, each said energy absorbing mechanism having a straight axially displaceable section to which said adjustable connectors are displaceably secured, and damping means secured to opposed ends of said straight axially displaceable section to maintain a cable under tension.

14. A vehicle restraining system as claimed in claim 13 wherein said straight axially displaceable section is a straight section of said cable, said adjustable connectors being secured to said cable by a clamp to secure same at a desired location therealong.

15. A vehicle restraining system as claimed in claim 14 wherein said cable is a metal cable extending within a fixed rail secured to said transport carrier, said adjustable connectors being in sliding engagement with said fixed rail and having arresting lock means to lockingly engage same with said metal cable.

16. A vehicle restraining system as claimed in claim 15 wherein said arresting lock means is constituted by a hand-operable clamp bar secured to a clamping member of each said adjustable connector whereby to clampingly engage said clamping member with said cable.

17. A vehicle restraining system as claimed in claim 16 wherein said adjustable connector is comprised of a cradle slidingly supported on said rail, said hand-operable clamp bar being pivotally secured to said clamping member positioned about said cable, said clamping member being U-shaped with said clamp bar pivotally connected between a pair of depending arms of said clamping member extending on opposed sides of said cable, said clamping bar having an eccentric head positioned under an extension wall of said cradle and pivotally connected between said depending arms and wherein downward displacement of said clamp bar causes said eccentric head to engage with a lower face of said extension wall causing said U-shaped clamping member to be pulled on said cable thereby clamping said cable in frictional engagement with an upper surface of said extension wall to immovably connect said cradle with said cable.

18. A vehicle restraining system as claimed in claim 14 wherein each said damping means is constituted by a preloaded helical spring retained captive in a damping cylinder housing between an entrance end wall, thereof through which a straight cable end rod projects, and a disc secured about said cable end rod inside said cylinder housing and spaced from said entrance end wall; an internal wall in said cylinder housing and having an opening therein through which said straight cable end rod passes, and opening obstruction means biased against said opening of said internal wall on a side thereof opposite to a side facing said disc, and vacuum damping means defined in said damping cylinder housing by a damping space defined between said disc and said internal wall.

19. A vehicle restraining system as claimed in claim 17 wherein said cable, when displaced in a first axial direction, causes a damping cylinder housing secured at one end of said cable to compress a pre-loaded helical spring and simultaneously causing said pre-loaded helical spring in said damping cylinder at another end to relax; two springs creating a restoring force to return said cable to an initial at-rest position in a restrained controlled fashion.

20. A vehicle restraining system as claimed in claim 17 wherein vacuum damping means is provided by a chamber defined between an internal wall and a disc, said disc in one portion of a damping cylinder housing, when displaced in the direction of said internal wall by a displacement of said cable, causing pressure to build-up in said chamber and simultaneously causing controlled release of pressure through a spring-biased disc valve obstructing an opening in said internal wall about a straight cable end rod; said disc in another portion of said damping cylinder housing when displaced in a direction away from said internal wall causing a suction to draw air into said chamber through said opening in said internal wall while compressing a pre-loaded helical spring to apply a restoring force on said disc which is transmitted to said cable.

21. A vehicle restraining system as claimed in claim 1 wherein said connector strut is provided with storage position engagement means to retain said connector strut at an immovable stored position when not in use.

* * * * *